US005590531A

United States Patent [19]

Desaulty et al.

[11] Patent Number: 5,590,531

[45] Date of Patent: Jan. 7, 1997

[54] PERFORATED WALL FOR A GAS TURBINE ENGINE

[75] Inventors: Michel A. A. Desaulty, Vert Saint Denis, France; Denis J. M. Sandelis, Nangis; Pierre M. V. E. Schroer, Brunoy, all of France

[73] Assignee: Societe National D'Etdue et de Construction de Moteurs D'Aviation S.N.E.C.M.A., Paris Cedex, France

[21] Appl. No.: 355,474

[22] Filed: Dec. 14, 1994

[30] Foreign Application Priority Data

Dec. 22, 1993 [FR] France ..... 93 15394

[51] Int. Cl.[6] ..... F23R 3/06

[52] U.S. Cl. ..... 60/752; 60/757

[58] Field of Search ..... 60/752, 755, 754, 60/757

[56] References Cited

U.S. PATENT DOCUMENTS

| | | | |
|---|---|---|---|
| 4,695,247 | 9/1987 | Enzaki et al. | 431/352 |
| 5,241,827 | 9/1993 | Lampes | 60/754 |
| 5,398,509 | 3/1995 | North et al. | 60/755 |

FOREIGN PATENT DOCUMENTS

| | | | |
|---|---|---|---|
| 0512670 | 11/1992 | European Pat. Off. . | |
| 2049152 | 12/1980 | United Kingdom . | |
| 2061482 | 5/1981 | United Kingdom . | |
| 2200738 | 8/1988 | United Kingdom | 60/757 |

*Primary Examiner*—Timothy S. Thorpe
*Attorney, Agent, or Firm*—Bacon & Thomas

[57] ABSTRACT

A wall structure for a gas turbine engine structure, such as a combustion chamber or an afterburner duct is disclosed having a plurality of cooling orifices formed through the wall located in a plurality of odd and even transverse rows, each row having a plurality of cooling orifices located in a plane extending substantially perpendicular to a longitudinal axis of symmetry with the cooling orifices of each odd and even row being circumferentially offset from the cooling orifices of the adjacent upstream corresponding odd and even row. The cooling orifices have a common diameter D and are circumferentially offset a distance d such that distance d is between 0.5 D and D. The axes of the orifices in the odd numbered rows lie on a first main line extending obliquely to the longitudinal axis of symmetry and to the oxidizer air flow, and the axes of orifices on the even numbered rows lie on a second main line, also extending obliquely to the longitudinal axis of symmetry and to the oxidizer air flow. The axes of the orifices in the adjacent rows lie on secondary lines which extend obliquely to the first and second main lines and also to the longitudinal axis of symmetry. Any weld joints necessary to form the annular combustion chamber or afterburner duct from a plurality of wall segments extend parallel to the secondary lines and may be spaced equidistantly from adjacent secondary lines.

8 Claims, 4 Drawing Sheets

PERFORATED WALL FOR A GAS TURBINE ENGINE

BACKGROUND OF THE INVENTION

The present invention relates to a wall structure for a gas turbine engine, particularly for bounding areas of the gas turbine engine containing gases at elevated temperatures, such as combustion chamber walls or afterburner duct walls.

It is known to provide cooling for walls bounding portions of a gas turbine engine which contain gases at elevated temperatures by providing multiple perforations through the wall to enable a thin film of cooling air to be formed on the inside of the wall surface to protect the wall from the effects of the elevated gas temperatures. The known gas turbine engines direct a portion of the oxidizer, typically air, onto the outer wall surface such that it may pass through the wall via a plurality of small orifices formed in the wall to be cooled.

To achieve optimum cooling permeability, the cooling orifices have been arranged in an array illustrated in FIG. 1A. This conventional cooling orifice array forms a heterogeneous and periodic local air flow output at the chamber outlet which depends upon the positions of the orifices which are generally aligned parallel to the longitudinal axis of symmetry and parallel to the air flow through the engine. The maximum output is obviously located downstream of the aligned orifices.

Typically, gas turbine engine combustion chambers and turbojet engine afterburner ducts are formed from several segments of metal sheet having juxtaposed edges which may be rolled and subsequently welded to form the typically annular structure. The segments from which the annular structures are made have sides which are typically cut off at right angles to their upstream and downstream ends thereby forming a welding seam which runs generally perpendicular to the upstream and downstream edges and, hence, generally parallel to the longitudinal axis of the engine and to the flow of cooling air.

During fabrication of the structural segments which are formed with multiple perforations to achieve the necessary cooling, the positioning of the orifices frequently requires that an axial row of orifices are fabricated closely adjacent to the site of the welding seam, thereby degrading the mechanical strength of the completed annular structure. The elimination of the axial row of orifices close to the welding seam causes an adverse wake to be formed in the air flow which will decrease the cooling efficiency of the air flow at the structure outlet.

It is known that the internal temperatures change between the upstream end of a combustion chamber and the downstream outlet end. The walls which define the inner and outer boundaries of an annular combustion chamber typically are formed in a cylindrical configuration for the outer boundary wall and a frustoconical configuration for the inner boundary wall. Obviously, cooling of the walls using multiple perforations must coincide with the different temperatures present in different axial positions within the combustion chamber.

SUMMARY OF THE INVENTION

A wall structure for a gas turbine engine structure, such as a combustion chamber or an afterburner duct is disclosed having a plurality of cooling orifices formed through the wall located in a plurality of odd and even transverse rows, each row having a plurality of cooling orifices located in a plane extending substantially perpendicular to a longitudinal axis of symmetry with the cooling orifices of each odd and even row being circumferentially offset from the cooling orifices of the adjacent upstream corresponding odd and even row. The cooling orifices have a common diameter D and are circumferentially offset a distance d such that distance d is between 0.5 D and D. The axes of the orifices in the odd numbered rows lie on a first main line extending obliquely to the longitudinal axis of symmetry and to the oxidizer air flow, and the axes of orifices on the even numbered rows lie on a second main line, also extending obliquely to the longitudinal axis of symmetry and to the oxidizer air flow.

The axes of the orifices in the adjacent rows lie on secondary lines which extend obliquely to the first and second main lines and also to the longitudinal axis of symmetry. Any weld joints necessary to form the annular combustion chamber or afterburner duct from a plurality of wall segments extend parallel to the secondary lines and may be spaced equidistantly from adjacent secondary lines.

The wall according to the present invention improves the homogeneity of the cooling air flow by consecutively circumferentially offsetting the orifice positions. The welding seam connecting adjacent segments together extends obliquely relative to the flow of cooling air to maintain the structural rigidity of the completed structure, while at the same time minimizing any wakes generated in the cooling air flow. Finally, an objective of the present invention is make the permeability of the annular structure vary along the axial direction of the structure.

The wall according to the present invention may be utilized to bound an annular combustion chamber of a gas turbine engine which extends about a longitudinal axis of symmetry. The combustion chamber is bounded by at least one axially extending wall defining a plurality of cooling orifices constituting multiple perforations to pass a cooling fluid through the axial wall. The cooling orifices have a common diameter and are arrayed in transverse odd and even rows, the orifices in a given row being located in a plane which extends substantially perpendicular to the longitudinal axis of symmetry. The orifices of consecutive odd rows are circumferentially displaced from the adjacent upstream odd row such that the axes of the orifices in the odd rows lie on a first main line which extends obliquely to the longitudinal axis of symmetry and to the direction of cooling gas flow. Similarly, the orifices of each consecutive even row are circumferentially offset from a corresponding orifice in the upstream adjacent even row such that the axes of the orifices lie on a second main line which also extends obliquely with respect to the longitudinal axis of symmetry and to the direction of cooling gas flow.

The orifices of subsequent odd or even rows are circumferentially displaced a distance d from a corresponding orifice in an immediately upstream corresponding odd or even row such that the distance d lies between 0.5 D and D, wherein D is the common diameter of all of the orifices. The axes of the orifices of each adjacent row also lie on secondary lines which, again, extend obliquely with respect to the longitudinal axis of symmetry and to the direction of gas flow, as well as to the first and second main lines. Welds which connect the edges of adjacent segments to form the completed combustion chamber or duct structure extend parallel to the secondary lines and are equidistantly spaced from adjacent secondary lines. The weld junction is spaced from adjacent secondary lines on either side of the weld a distance equal to the spacing between adjacent secondary lines.

If the annular structure has a frustoconical configuration, the ratio of the distance between two consecutive orifices of the same row to the distance between two consecutive rows remains constant along the axial length of the structure. Given the frustoconical configuration of the structure, the constant ratio will cause the orifice density to decrease from the upstream edge of the combustion chamber toward the downstream outlet end.

If the wall has a substantially cylindrical configuration, the ratio of the distance between two consecutive orifices of the same row to the distance between two consecutive rows will increase in a direction from the downstream outlet of the combustion chamber towards the upstream end wall, with the ratio preferably being at most equal to 0.3. Again, this will decrease the orifice density from the upstream edge of the wall in a direction towards the downstream edge of the wall.

The primary advantage of the invention is the improved homogeneity in cooling the wall of the combustion chamber or the afterburner duct thereby increasing the high temperature combustion efficiency.

DETAILED DESCRIPTION OF THE PREFERRED EMBODIMENT

The present invention will be described in conjunction with an aircraft turbojet engine combustion chamber, however, it should be understood that the principles elucidated herein can be utilized for any enclosure within which exists high temperatures.

Figures 1A, 1B:
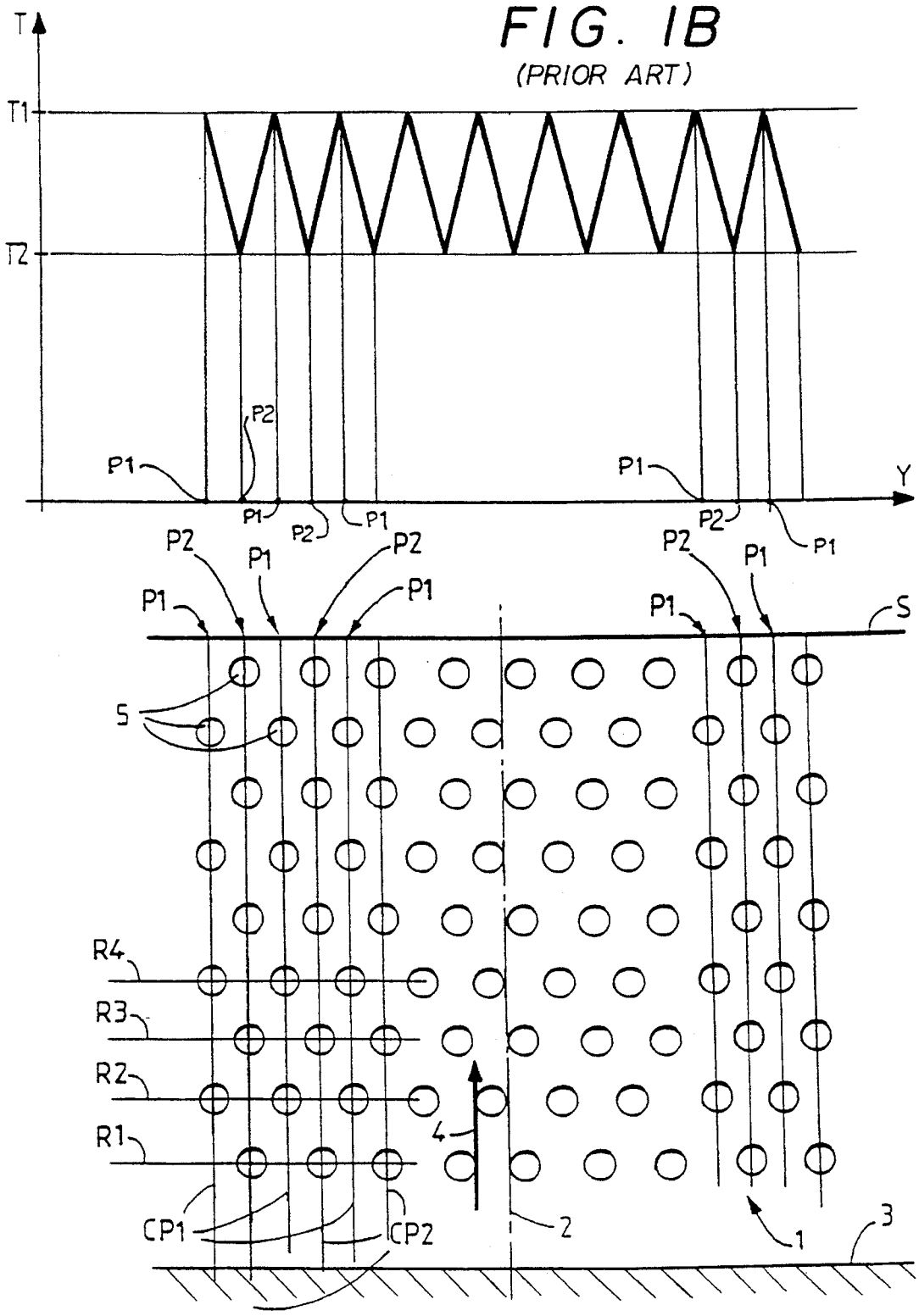
FIG. 1B (PRIOR ART)
FIG. 1A (PRIOR ART)
FIG. 1A is a partial, plan view of a wall having a known multiple perforation.
FIG. 1B is a graph illustrating the temperature variation at the downstream edge of the wall illustrated in FIG. 1A.

FIG. 1A illustrates the known wall 1 which extends in annular fashion about a longitudinal axis of symmetry 2 to form a portion of a gas turbine engine combustion chamber having an upstream combustion chamber end 3 and a downstream outlet S. The overall direction of cooling air flow is illustrated by arrow 4. As is well known in the art, a typical annular combustion chamber is bounded by an outer annular wall, an inner annular wall and an upstream end wall which extends transversely between and connects the upstream edges of the inner and outer walls. The downstream edges of the inner and outer walls define the outlet for the combustion chamber gases.

Wall 1 is perforated by a plurality of small orifices 5 through which a cooling fluid, which may also be the engine oxidizer such as compressed air, passes into the combustion chamber enclosure while cooling the wall surface. The orifices 5 of the cooling holes are arrayed in consecutive transverse rows R1, R2, R3, R4, . . . , the orifices in each row being located in a substantially transverse plane which extends perpendicular to the longitudinal axis of symmetry 2 and, hence, to the direction of cooling fluid flow 4. From the upstream end 3, an even row R2 follows an odd row R1 and, in turn, is followed by an odd row R3 from the upstream edges to the downstream edge of the wall 1. The orifices 5 of consecutive rows are mutually offset, those in even rows being aligned along a first main line CP1 which extends substantially parallel to the direction of cooling fluid flow 4 and those orifices in odd rows being axially aligned along second main lines CP2 which also extend parallel to the direction of cooling fluid flow 4. The lines CP1 and CP2 are mutually alternating, a line CP2 being located between two lines CP1 and vise versa. If the wall forms a substantially right-cylindrical structure about the axis of symmetry 2, the lines CP1 and CP2 are rectilinear.

The lines CP1 and CP2 intersect the plane of the outlet S which extends substantially perpendicular to the axis 2. Thus, the orifices 5 of the second to last and last rows of orifices (the two rows nearest the plane of the outlet S) are at different axial distances from the outlet S. The intersects P2 of the main lines CP2 on which are located the orifices 5 nearest the plane of the outlet S are more efficiently cooled than are the areas adjacent to the intersects P1 of the other main lines CP1 and the plane of the outlet S. The temperature T in the plane of the outlet S opposite the wall 1 varies between T2 and T1, which is larger than T2, as a function of the abscissa Y of points P1, P2, as shown in FIG. 1B. It is obviously desirable to make the temperature more homogeneous in the plane of the outlet S thereby making the temperature T more constant throughout the plane of the outlet S.

Figure 2:
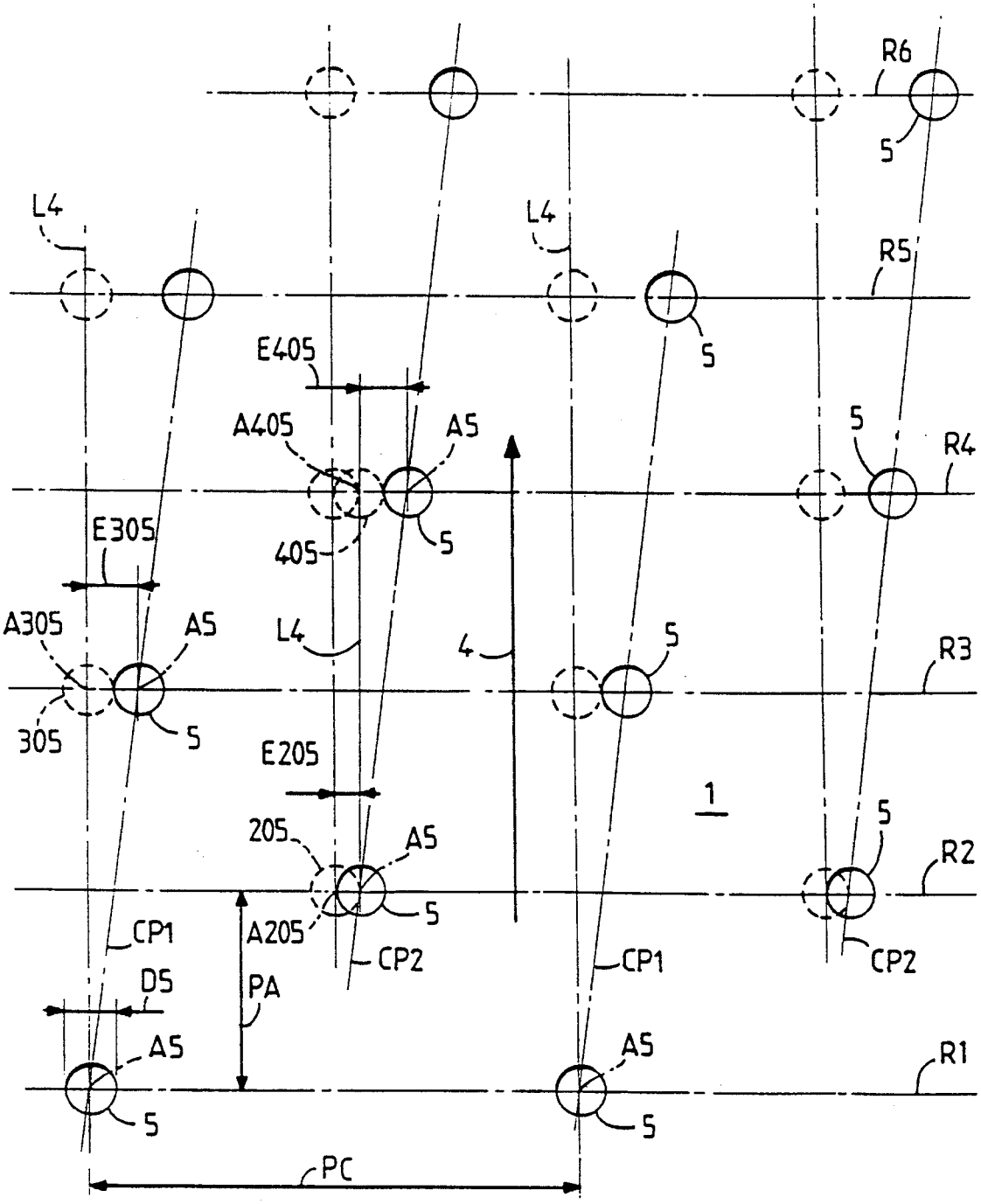
FIG. 2 is a partial, plan view of a wall having multiple perforations according to the present invention.
Figure 3:
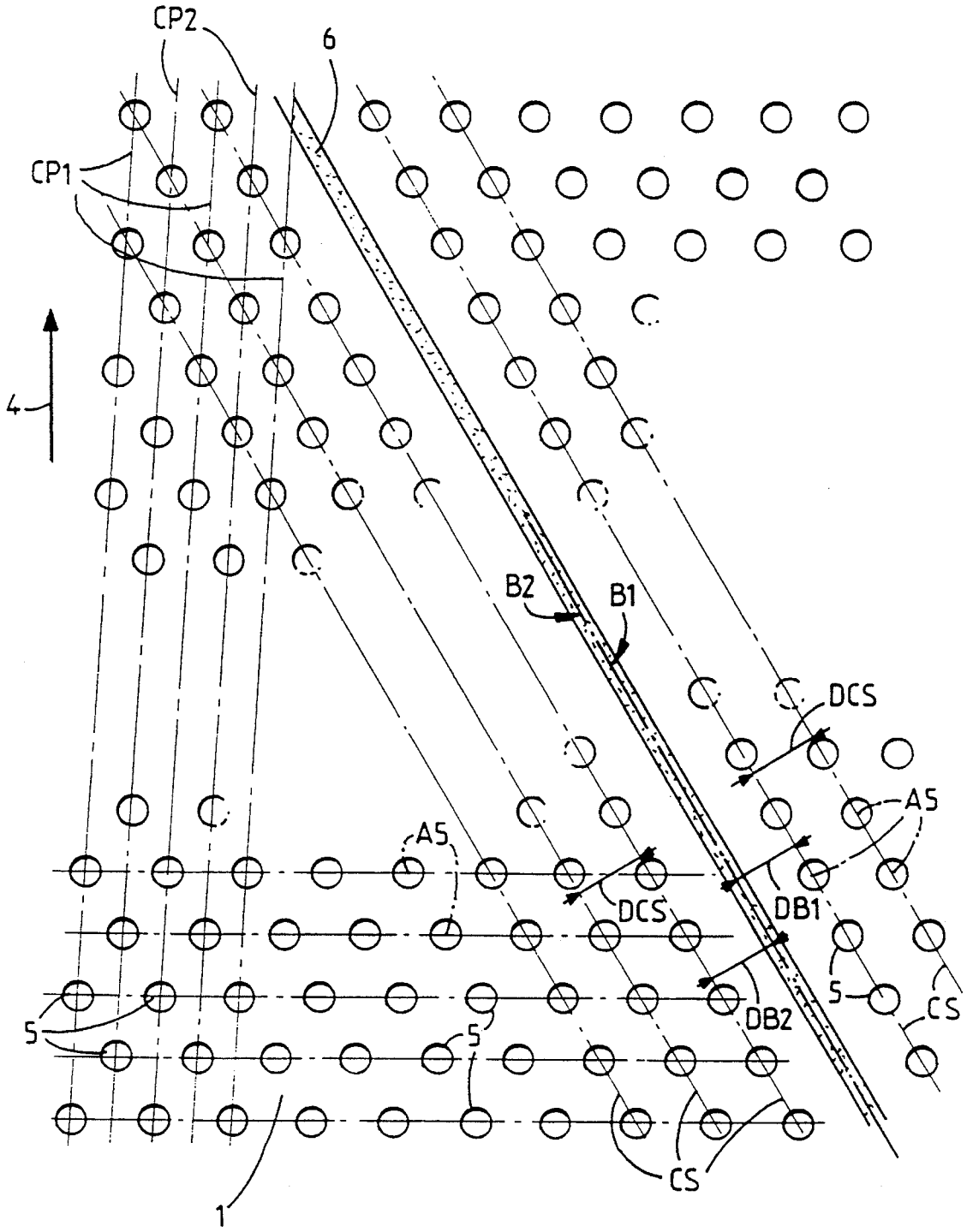
FIG. 3 is a partial, plan view of the wall according to the invention illustrating the welded connection between adjacent wall segments.

In the wall according to the present invention, as illustrated in FIGS. 2 and 3, the array of orifices 5 again includes odd rows R1, R3, R5. . . , and even rows R2, R4, R6. . . . The orifices 5 of subsequent rows of odd or even numbered rows are circumferentially offset from a corresponding orifice in the upstream adjacent odd or even row. As illustrated in FIG. 2, the axes A5 of orifices 5 of the odd numbered rows lie on main lines CP1, while the axes A5 of the orifices 5 in the even numbered rows lie on main lines CP2. Lines CP1 and CP2 extend obliquely to the direction of cooling fluid flow 4 and to the longitudinal axis of symmetry 2.

Each row has a plurality of orifices lying in a transverse plane which extends substantially perpendicular to the longitudinal axis of symmetry and to the direction of cooling fluid flow 4. Lines L4 passes through the axes of the orifices 5 in the most upstream rows, in this ease R1 and R2, and extend in a direction parallel to the direction of cooling fluid flow 4 and the longitudinal axis of symmetry. As can be seen, the distance E305 between the axis A5 of the orifice 5 in row R3 (the second odd numbered row) and the intersection A305 between row R3 and line L4 defines the slope of the line CP1 which extends through the two axes A5 of the orifices 5 on rows R3 and R1, and is a line on which are located all of the subsequent downstream orifices in subsequent downstream orifices in subsequent odd numbered rows.

Similarly, the distance E405, which is equal to the distance E305, exists between the axis A5 of an orifice 5 on row R4 (the second even numbered row) and the intersection A405 of this row R4 and the line L4 which extends through the axis A5 of an orifice 5 on row R2 (the first even numbered row). Line CP2 passes through the axes A5 and is a line on which are located all of the subsequent downstream orifices in subsequent even numbered rows.

The distances E305 and E405 have the following values:

$$(0.5)(D5)<E305<(1.0)(D5),$$

and $$(0.5)(D5)<E405<(1.0)(D5)$$

wherein D5 is the common diameter of all of the orifices 5.

The axis A5 of an orifice 5 of an even or odd numbered row also may be situated relative to the position A205 which is equidistant from two axes A5 of the immediately preceding row by a distance E205 which is ½ of the distance E305 and E405.

The slopes of the main lines CP1 and CP2 relative to the lines L4 are shallow, but nevertheless overlap their impact cooling zones in the plane of the outlet S which suppresses or reduces the differences between the temperatures T1 and T2 of the known structure illustrated in FIG. 1B. As can be seen in FIG. 3, the axes A5 of the orifices 5 also lie on secondary parallel lines CS which slope significantly relative to the direction of cooling fluid flow 4 and the longitudinal axis of symmetry. The wall 1 may be comprised of a plurality of rolled segments assembled by welding side edges of the segments B1, B2 together by a weld 6. The sides of the segments B1, B2 extend parallel to the lines CS and are located distances DB1, DB2 from the nearest line CS to improve the structural rigidity of the welded structure. Distances DB1 and DB2 are equal to the distances DCS between two adjacent secondary lines CS. The wall 1 is free of orifices 5 in the vicinity of the welded edges B1, B2 thereby enabling the wall 1 to retain its strength in the vicinity of the weld 6. Furthermore, the significant slope of the secondary lines CS relative to the direction of cooling fluid flow 4 and the longitudinal axis of symmetry avoids a discontinuity in the cooling fluid flow in the plane of the outlet S thereby alleviating any cooling discontinuities and increasing the temperature homogeneity at this point.

The circumferential pitch PC is defined as the circumferential distance between axes A5 of adjacent orifices of a given row, while the axial pitch PA is defined as the axial distance between two consecutive rows, as illustrated in FIG. 2. In this invention, both the density of the orifices 5 and the permeability of the wall 1 decrease from the upstream end 3 in a direction toward the downstream edge S. If the wall structure has a substantially frustoconical configuration about the longitudinal axis of symmetry 2, the ratio PC/PA increases from the plane of the outlet S towards the upstream combustion chamber end 3. For a substantially right cylindrical wall configuration about the axis 2, the ratio PC/PA increases from the plane of the outlet S towards the upstream combustion chamber end 3. Preferably, the ratio PC/PA does not exceed 0.3. With respect to either of the frustoconical or cylindrical configurations of the walls, the number of orifices 5 per row is substantially constant and the first and second main lines CP1 and CP2 are substantially continuous.

Figure 4:
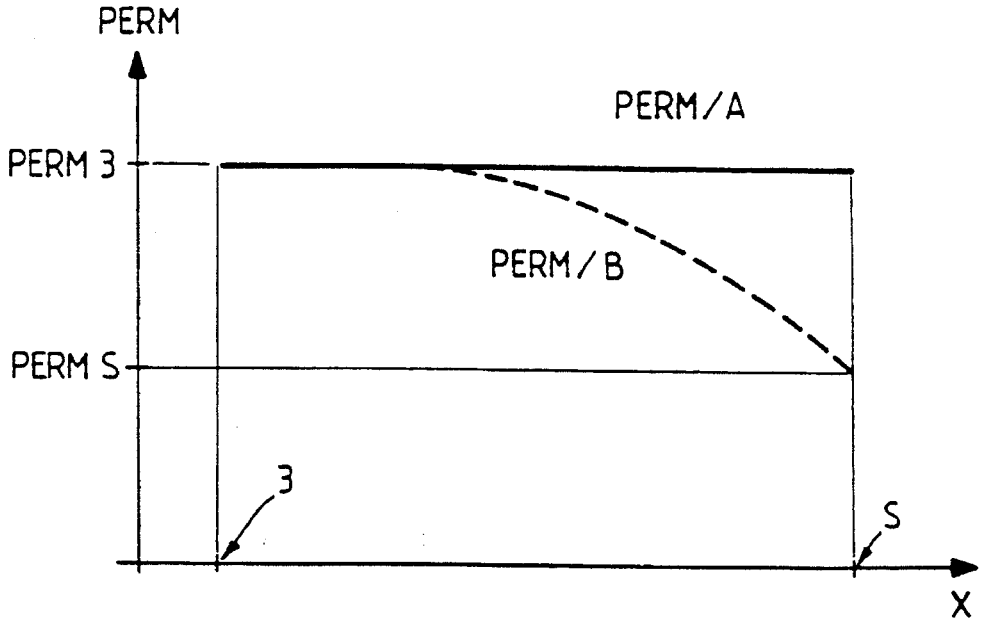
FIG. 4 is a graph illustrating the permeability of the known wall and the wall according to the invention.

The graph illustrated in FIG. 4 shows the variation of the permeability (PERM) of the wall 1 as a function of the axial distance X from the upstream end of the combustion chamber 3 towards the plane of the outlet S. The curve PERM/A shown in a solid line represents the essentially constant permeability value PERM 3 equal to the permeability of a wall 1 in the vicinity of the combustion chamber end 3. The curve PERM/A illustrates the known configuration of the prior art walls. The dashed curve PERM/B represents the permeability value of a wall 1 of the invention which, as can be seen, varies between a lower value PERM S of the wall in the vicinity of the outlet S and an upper value PERM 3 in the vicinity of the upstream combustion chamber end 3.

Figure 5:
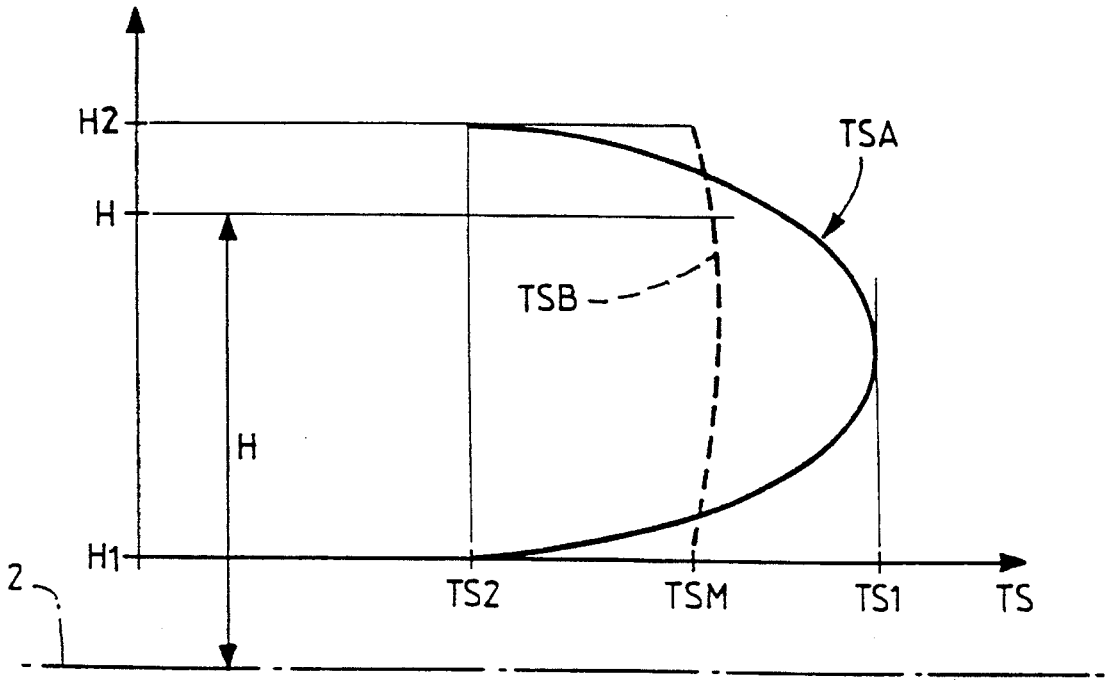
FIG. 5 is a graph illustrating downstream edge temperatures of the known wall and the wall according to the present invention.

The curves illustrated in FIG. 5 show temperature variations TS of the gases passing through the plane of the outlet S as a function of the radial distance H relative to the longitudinal axis of symmetry 2. In the prior art walls, the temperature varied between TS2 and TS1 and would be equal to TS2 when the distance H varied between its minimum value H1 and its maximum value H2, as illustrated by the solid TSA curve. The dashed curve TSB illustrates the substantially constant temperature TS having a mean value TSM which results from using the walls 1 of the present invention.

The present invention is advantageous since it achieves a more homogeneous temperature distribution, especially in the sensitive zones of the axial walls 1 and eliminates or reduces temperature peaks in the walls, including the weld zones. This enables the walls 1 to last longer, while at the same time permitting a higher combustion efficiency due to the increase of the maximum admissible temperatures.

The foregoing description is provided of illustrative purposes only and should not be construed as in any way limiting this invention, the scope of which is defined solely by the appended claims.

We claim:

1. A gas turbine engine having an annular wall bounding a chamber containing gases at elevated temperatures wherein the wall extends about a longitudinal axis of symmetry having an upstream edge and a downstream edge located in planes extending substantially perpendicular to the longitudinal axis of symmetry and comprising: a plurality of cooling orifices defined by the wall, the plurality of cooling orifices each having a common diameter D and located in a plurality of alternating odd and even transverse rows, each row having a plurality of cooling orifices located in a plane extending substantially perpendicular to the longitudinal axis of symmetry, the cooling orifices of each odd row being circumferentially offset from the cooling orifices of the adjacent upstream odd row a distance d such that $0.5D \leqq d \leqq D$ wherein cooling orifices in the odd rows lie on first main lines extending obliquely to the longitudinal axis of symmetry and the cooling orifices of each even row being circumferentially offset from the cooling orifices of the adjacent upstream even row a distance d such that $0.5D \leqq d \leqq D$ wherein orifices in the even rows lie on second main lines extending obliquely to the longitudinal axis of symmetry.

2. The gas turbine engine wall of claim 1 wherein the orifices in adjacent rows lie on secondary lines extending obliquely to the first and second main lines and to the longitudinal axis of symmetry.

3. The gas turbine engine wall of claim 2 comprising a plurality of segments forming the annular wall, each segment having a side welded to a side of an adjacent segment such that the sides and welds extend substantially parallel to the secondary lines.

4. The gas turbine engine wall of claim 3 wherein the weld joint is equidistantly spaced between adjacent secondary lines.

5. The gas turbine engine wall of claim 3 wherein the secondary lines of each segment are mutually spaced apart a distance DCS and wherein the weld is spaced from adjacent secondary lines a distance equal to the distance DCS.

6. The gas turbine engine wall of claim 1 wherein the annular wall is frustoconical in configuration having the orifices of a given row circumferentially spaced apart a distance PC and adjacent rows axially spaced apart a distance PA such that the ratio PC/PA is substantially constant along the axial length of the wall, thereby decreasing the orifice density in a direction from the upstream edge to the downstream edge.

7. The gas turbine engine wall of claim 1 wherein the annular wall is cylindrical in configuration having the orifices of a given row circumferentially spaced apart a distance PC and adjacent rows axially spaced apart a distance PA such that the ratio PC/PA increases in an axial direction from the downstream edge towards the upstream edge thereby decreasing the orifice density in a direction from the upstream edge of the downstream edge.

8. The gas turbine ending wall of claim 7 wherein the ratio PC/PA does not exceed 0.3.

* * * * *